US009447780B2

(12) United States Patent
Rogers

(10) Patent No.: US 9,447,780 B2
(45) Date of Patent: Sep. 20, 2016

(54) OVER-CENTER LINKAGE

(75) Inventor: John Anthony Rogers, Broadstone Dorset (GB)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 312 days.

(21) Appl. No.: 13/635,748

(22) PCT Filed: Mar. 16, 2011

(86) PCT No.: PCT/US2011/028623

§ 371 (c)(1),
(2), (4) Date: Sep. 18, 2012

(87) PCT Pub. No.: WO2011/116061

PCT Pub. Date: Sep. 22, 2011

(65) Prior Publication Data

US 2013/0017102 A1 Jan. 17, 2013

(30) Foreign Application Priority Data

Mar. 19, 2010 (GB) ..... 1004604.3

(51) Int. Cl.

| | |
|---|---|
| ***F04B 9/135*** | (2006.01) |
| ***F04B 43/073*** | (2006.01) |
| ***F04B 7/00*** | (2006.01) |
| ***F04B 39/08*** | (2006.01) |

(52) U.S. Cl.

CPC ..... *F04B 7/0015* (2013.01); *F04B 39/08* (2013.01); *F04B 43/0736* (2013.01); *F04B 9/135* (2013.01)

(58) Field of Classification Search

CPC F04B 43/0736; F04B 45/0536; F04B 9/133; F04B 9/135; F04B 9/1315

USPC ..... 417/393, 395

See application file for complete search history.

(56) References Cited

U.S. PATENT DOCUMENTS

| | | | | |
|---|---|---|---|---|
| 326,545 | A | 9/1885 | Class et al. | |
| 4,172,698 | A * | 10/1979 | Hinz et al. | 417/393 |
| 4,406,596 | A | 9/1983 | Budde | |
| 4,597,414 | A | 7/1986 | Johnson | |
| 5,240,390 | A | 8/1993 | Kvinge et al. | |
| 5,664,940 | A * | 9/1997 | Du | 417/393 |
| 2010/0215519 | A1* | 8/2010 | Krebs et al. | 417/393 |

FOREIGN PATENT DOCUMENTS

| | | | |
|---|---|---|---|
| DE | 102006015675 | A1 | 10/2007 |
| EP | 0237677 | A1 | 9/1987 |

(Continued)

OTHER PUBLICATIONS

An International Search Report and Written Opinion, dated Jun. 15, 2011 in International Application No. PCT/US2011/028623.

(Continued)

*Primary Examiner* — Peter J Bertheaud
(74) *Attorney, Agent, or Firm* — Fletcher Yoder P.C.

(57) ABSTRACT

A novel changeover mechanism for a compressed air driven double diaphragm pump comprises a shaft slidably mounted through aligned apertures in opposing surfaces of the twin diaphragm chambers. At the center of the shaft between the two diaphragm chambers is provided an annular notch in to which is located an arm extending from a U shaped frame. The U shaped frame is pivotally mounted atop a valve plate which includes multiple ports.

34 Claims, 5 Drawing Sheets

(56) References Cited

FOREIGN PATENT DOCUMENTS

| | | | |
|---|---|---|---|
| EP | 0780574 | A1 | 6/1997 |
| JP | H05288159 | A | 11/1993 |
| JP | 3387895 | B2 | 3/2003 |

OTHER PUBLICATIONS

EP Examination Report; Application No. EP 11710626.0; Dated Nov. 26, 2015; 4 pages.
GB Examination Report; Application No. GB 1004604.3; Dated Dec. 17, 2015; 4 pages.

* cited by examiner

OVER-CENTER LINKAGE

RELATED APPLICATIONS

The present application is based on International Application No. PCT/US2011/028623, filed Mar. 16, 2011 and claims priority from United Kingdom Application Number 1004604.3, filed Mar. 19, 2010.

The present invention relates to diaphragm pumps and in particular to compressed air driven double diaphragm pumps.

Compressed air driven double diaphragm pumps are known. Such pumps are commonly used in paint spraying applications. Typically these pumps comprise twin air regulators which independently control the pump and spray gun pressures, plus an outlet fluid filter/bypass pressure dump assembly along with a filtered inlet for providing clean and filtered fluid to the spray gun. The contents of the fluid material container can be constantly replenished whilst the pump is in operation, enabling all of the spray material to be used without waste thereby minimising down time and facilitating quick and simple colour change operations.

The construction of a typical prior art valve is illustrated and further described in FIG. 1 below.

In this prior art design, changeover of the pump is achieved through poppet valves which are alternately operated by a washer located on the inside of twin diaphragms. When operated, a poppet valve is configured to effect a change in position of a control valve to reverse the direction of the pump by pressurising and exhausting the inner diaphragm chambers alternately.

The prior art design is for the most part effective; however the inventors have identified some areas for improvement. For example, variations in manufacturing tolerances can result in the seals applying excessive friction to the valve which can cause unwanted positioning mid stroke, stopping the pump from operating. In this situation it becomes necessary to reset the pump. Resetting requires manual intervention and a consequent down time of the pump.

The present invention provides a novel and alternative mechanism for effecting changeover of the pump. The proposed mechanism provides an effective and more reliable pump without compromise on manufacturing and running costs.

In accordance with the present invention there is provided a compressed air driven double diaphragm pump including a twin pair of diaphragm chambers and a changeover mechanism configured alternately to pressurise and exhaust the two diaphragm chambers, the changeover mechanism comprising a shaft slidably mounted through aligned apertures in opposing surfaces of the twin diaphragm chambers, means for driving the shaft to move axially in forward and reverse directions, a valve comprising a fixed valve plate having a plurality of ports in fluid communication with the twin diaphragm chambers and a valve closure component slidably mounted with respect to the fixed valve plate for selectively closing one or more of the ports, an arm pivotably mounted with respect to the valve and engaging with the shaft, the fixed valve plate hingedly linking with the arm and resilient biasing means associated with the hinged link for biasing the position of the valve closure component to off centre of the valve plate.

In use the shaft is driven to move axially. As the shaft moves, it carries the arm causing it to pivot about the pivot point adjacent the valve thereby pushing the valve closure component along the valve plate. The resilient biasing means ensure continuing close contact between the valve plate and valve closure component. As the valve closure component travels across the valve plate it opens ports communicating with one of the twin diaphragms and closes ports communicating with the other diaphragm. Reverse movement of the shaft brings about the opposite. The mechanism thus switches pressurisation and exhaustion between the diaphragms changing direction of the pump.

In a preferred embodiment, the arm comprises a substantially U shaped frame pivotally fixed on two opposing surfaces of the valve plate and slots provided in parallel extensions of the frame, a hinge received in the slots and connecting with a pair of linear tension springs which in turn are secured to the frame adjacent the pivot points.

An advantage of the present invention is that it permits an easily retrofittable module to be provided which can be installed or removed form the pump for maintenance or repair without the need for disassembly of any major components of the pump. In accordance with an aspect of the invention such a module is provided independently of the pump.

The prior art arrangement and an embodiment of the invention are now described.

Figure 1:
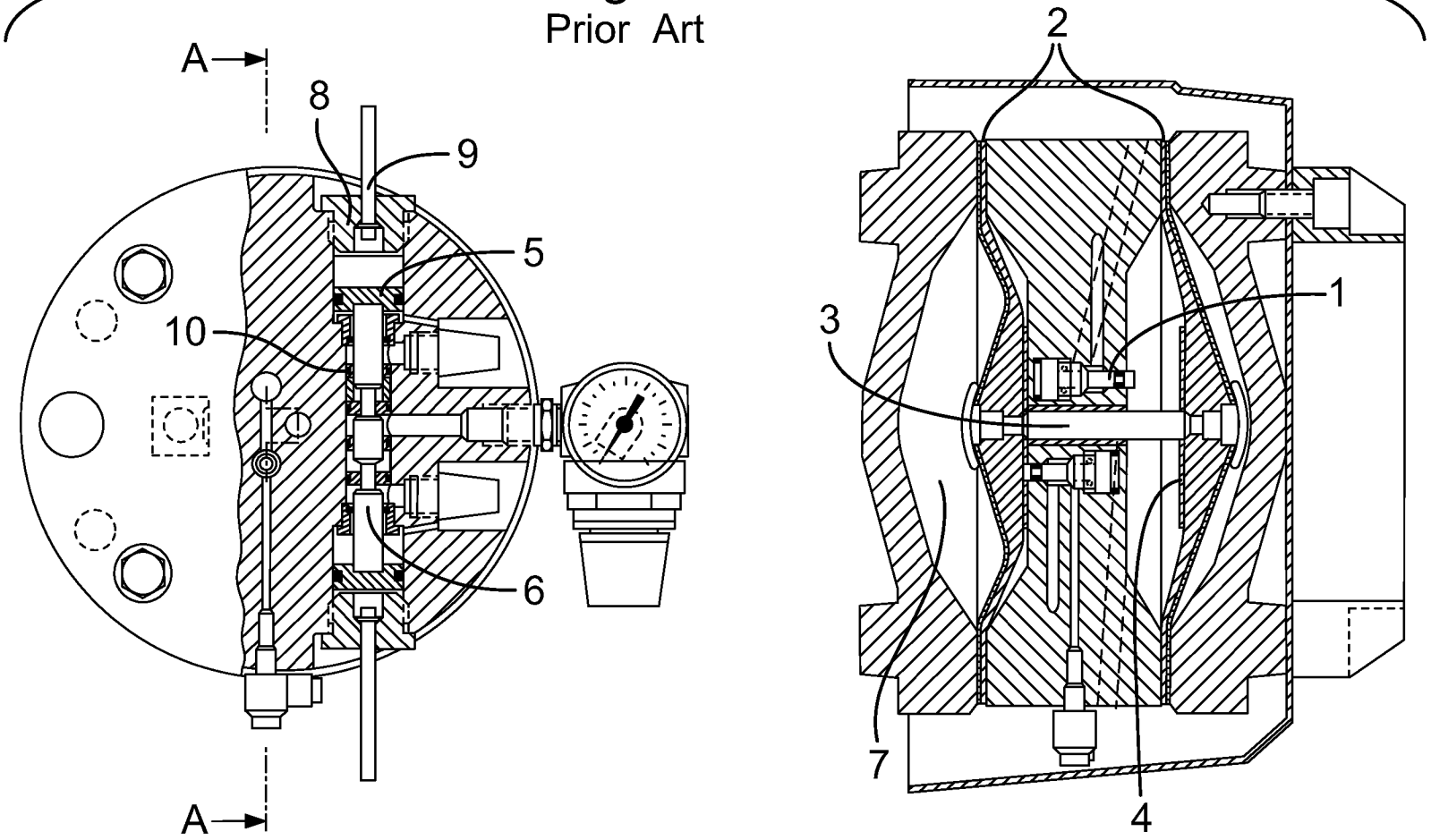
Fig. 1 Prior Art
FIG. 1 shows a double diaphragm pump using poppet valves as is known from the prior art and described briefly above.

As can be seen from FIG. 1, a prior art pump includes a pair of poppet valves (1), each directionally controlling pressurisation and exhaustion of one of a twin pair of diaphragms (2). The diaphragms are linked by a slidably mounted shaft (3) configured to move axially in a forward and reverse direction as the diaphragms (2) inflate and deflate. A washer (4) located in between the diaphragms (2) alternately operates the poppet valves (1).

When operated each poppet valve (1) provides a pneumatic signal to the outside of a piston (5). This causes the control valve (6) to change position and reverse the direction of the pump by pressurising and exhausting the inner diaphragm chamber (7) with which the poppet valve (1) is associated. As the poppet valves (1) are alternately operated, the diaphragm chambers (7) are alternately pressurised and exhausted.

The signal produced by the poppet valves (1) are only present while being depressed, the air operating the piston (5) is exhausted by the clearance between the end cap (8) and pin (9) once the poppet valve (1) is closed.

As discussed above, variation in tolerances can cause the seals (10) to apply excessive friction to the control valve (6), which can cause the control valve (6) to be positioned mid stroke and cause the pump to stop. This can be reset by manual intervention using the pin (9).

Figure 2:
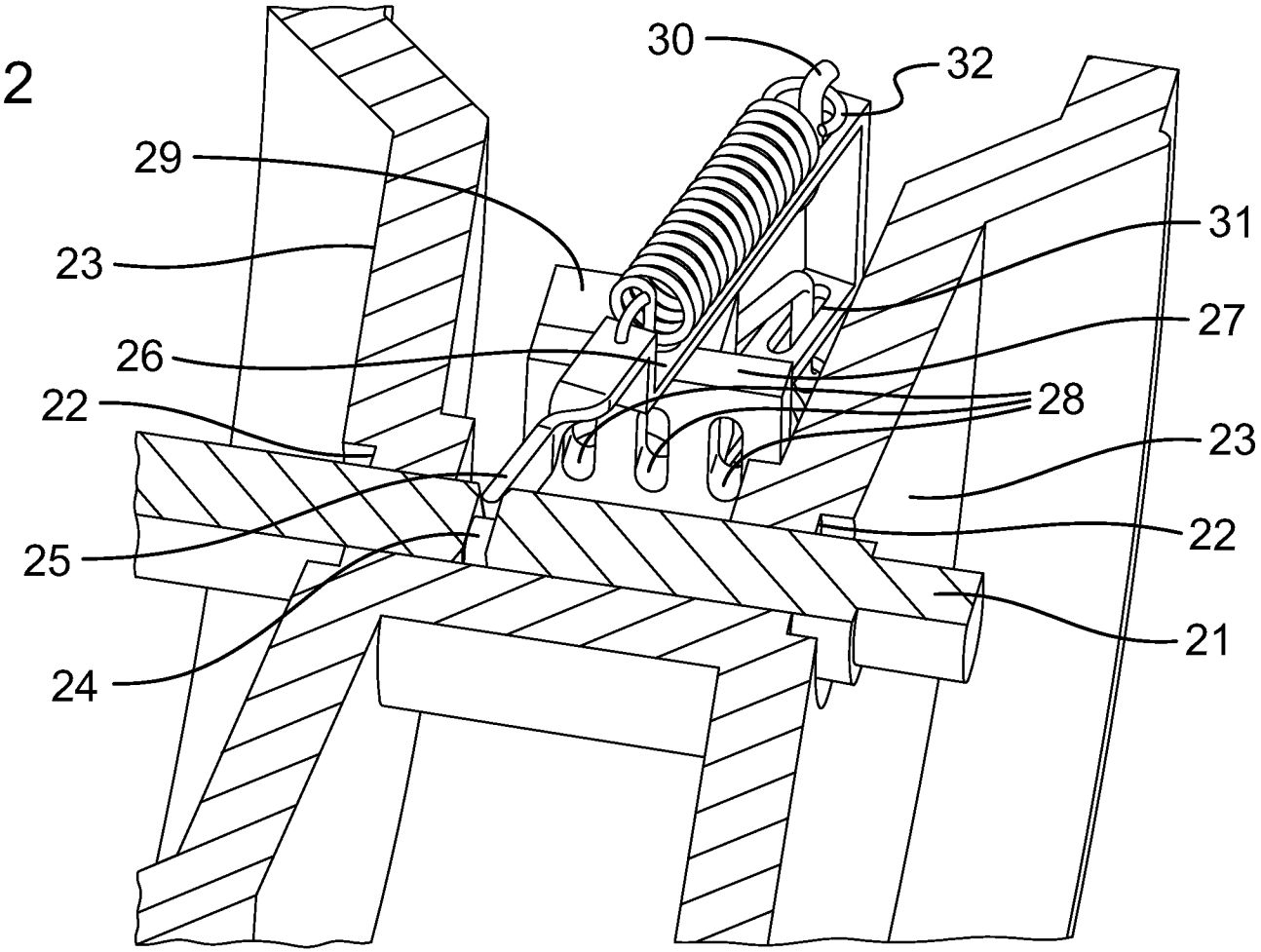
FIG. 2 shows a section through one embodiment of the present invention with the valve in a first position.

FIG. 2 shows a first view of an embodiment of a pump in accordance with the invention. The Figure shows only the detail of the novel changeover mechanism of the pump. Other features of the pump are as known from the prior art.

The novel mechanism comprises a shaft (21) slidably mounted through aligned apertures (22) in opposing surfaces of the twin diaphragm chambers (23). At the centre of the shaft (21) between the two diaphragm chambers (23) is provided an annular notch (24) in to which is located an arm (25) extending from a U shaped frame (26). The U shaped frame (26) is pivotally mounted atop a valve plate (27) by means of a pivot (see FIG. 5 reference (34)) which includes multiple ports (28). Positioned against a surface of the valve plate (27) is a valve closure component (29) which is configured to slide across the surface selectively obstructing the multiple ports (28).

The valve closure component (29) is held in place by a wire pusher or similar wire form fastener (30) hingedly mounted in slots (31) provided in parallel extension of the U shaped frame (26). Linear tension springs (32) connect the hinged peg (30) with U shaped frame (26) adjacent the pivot point. The springs (32) bias the position of the valve closure component (29) against the valve plate (27) in an off centre position.

Figure 3:
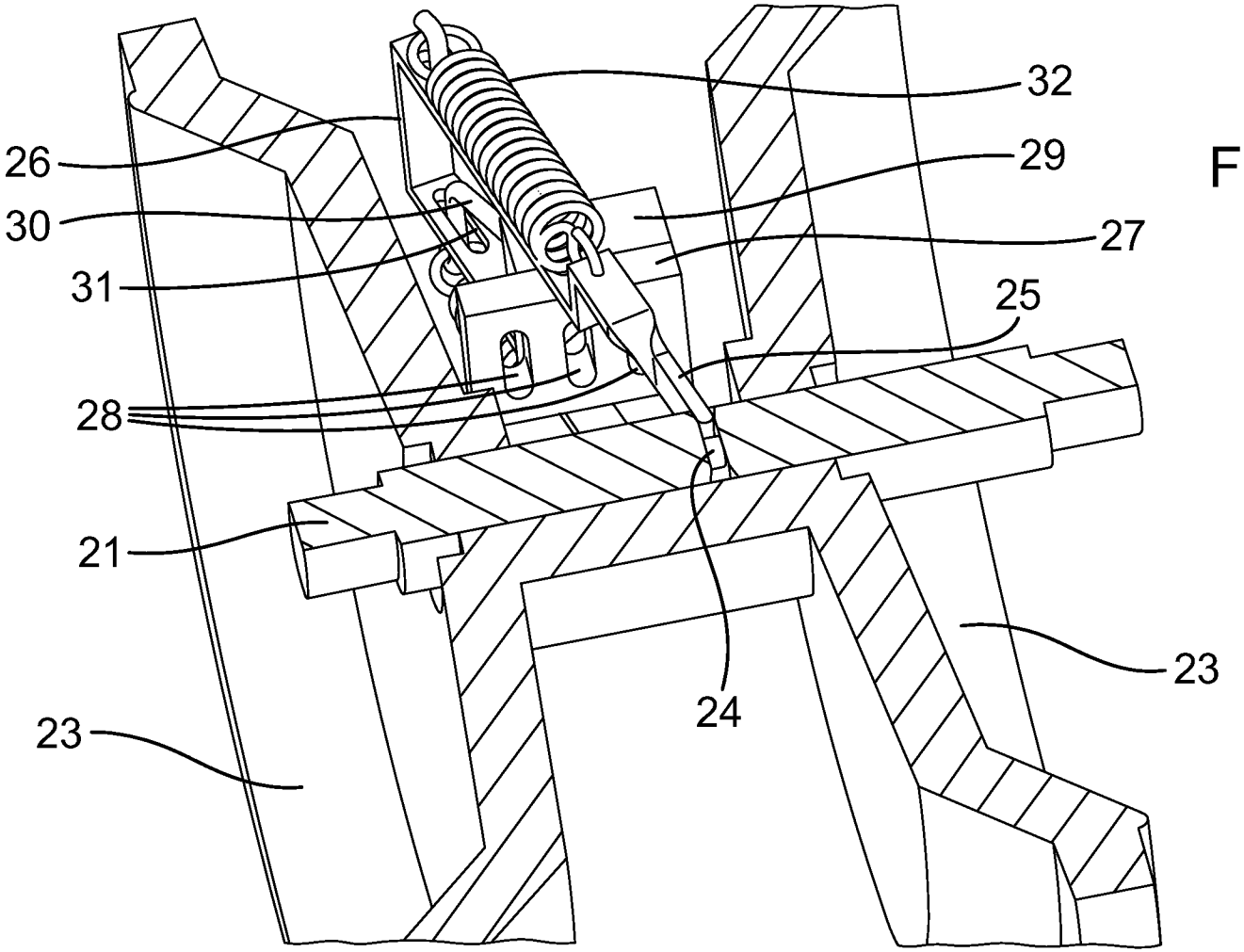
FIG. 3 shows a section through the embodiment of with the valve in a second position.

FIG. 3 shows the embodiment of FIG. 2 after switching of the pump has occurred. As can be seen shaft (21) has travelled axially in a direction from the left toward the right diaphragm chamber (23). Movement of the shaft (21) cause the notch (24) to drag the arm (25) causing rotation of the U shaped frame (26) about the pivot and consequentially sliding of the valve closure component (29) across the valve plate (27) opening ports (28) to the left of the figure and closing ports (28) to the right of the Figure. This results in exhaustion of the chamber (23) to the right of the Figure and pressurisation of the chamber (23) to the left of the Figure.

Figure 4:
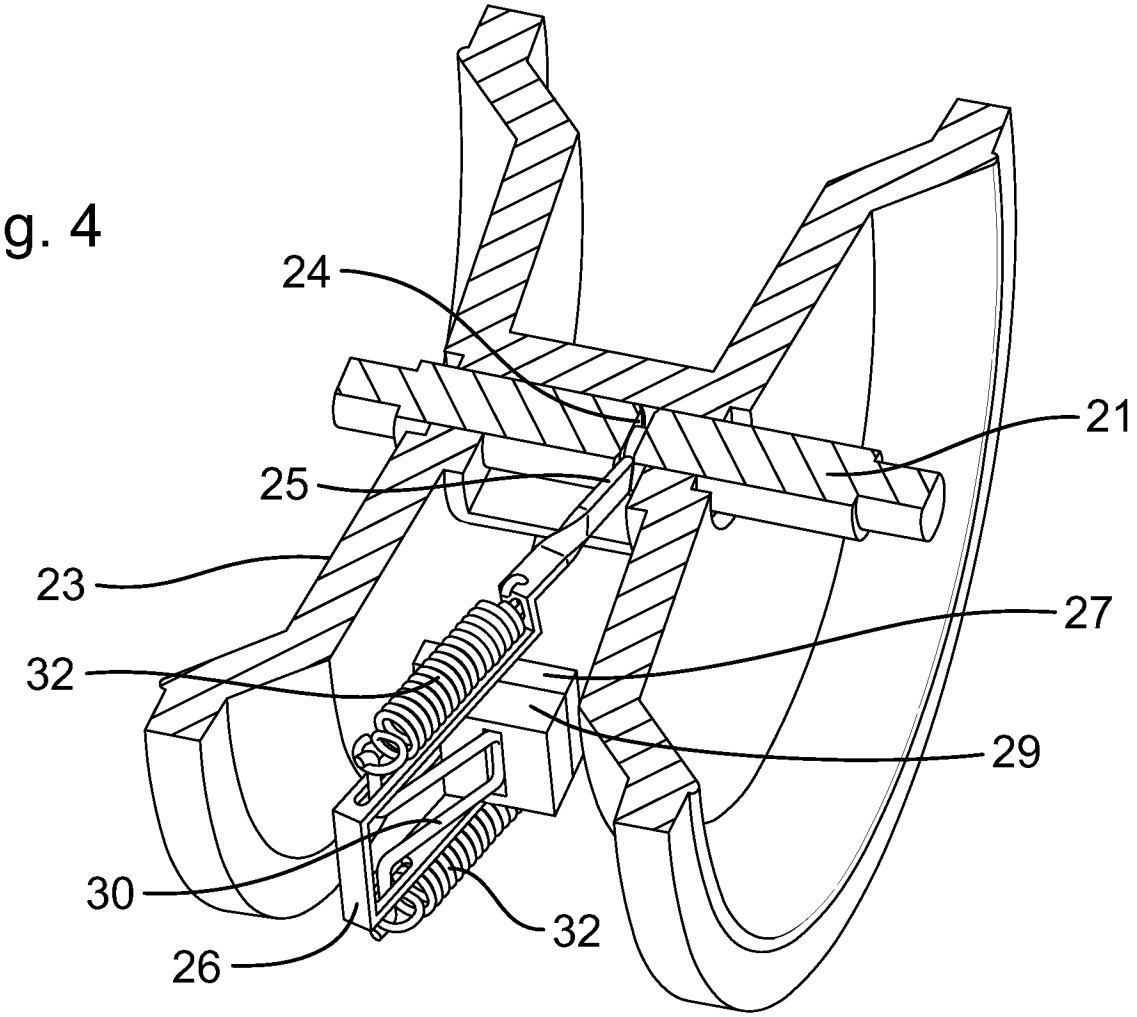
FIG. 4 shows an alternative section view of the embodiment of FIGS. 2 and 3.

FIG. 4 shows the embodiment of FIGS. 2 and 3 better illustrating the valve closure member (29), wire pusher (30), U shaped frame (26) and springs (32).

Figure 5:
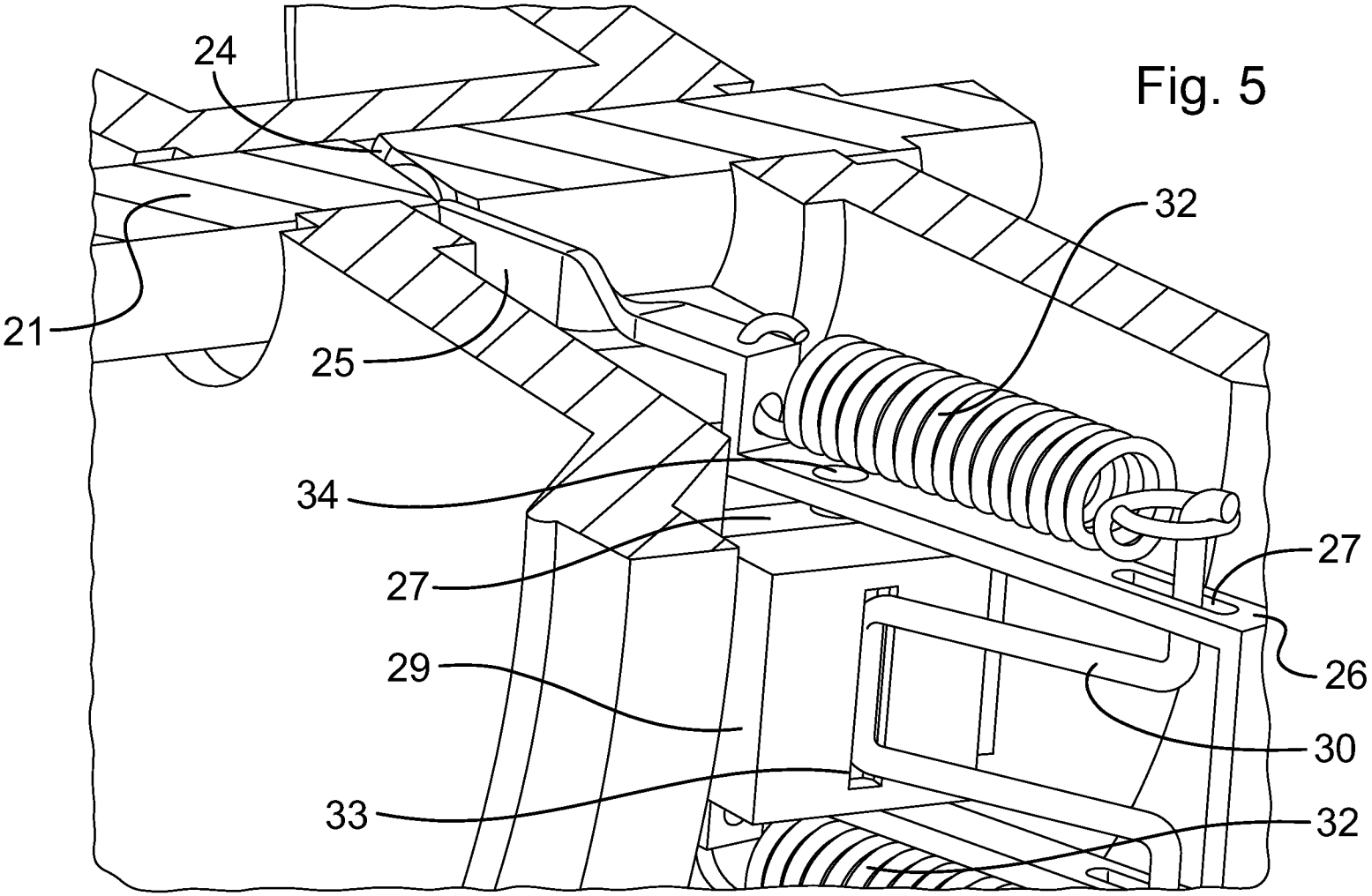
FIG. 5 shows change over mechanism of the embodiment of FIGS. 2 to 4 in closer detail.

FIG. 5 provides a closer view of the components detailed in FIG. 4 from another perspective. As can be seen the wire pusher (30) locates securely in a slot (33) provided in the rear of the valve closure component (29) thereby to retain the component against the valve plate (27).

The invention claimed is:

1. A system, comprising:

a pump, comprising:

a first chamber;

a second chamber;

a changeover assembly, comprising:

a valve portion having a plurality of ports;

a closure portion configured to slide along the valve portion and selectively open and close the plurality of ports to control pressurization and exhaustion of the first and second chambers;

a shaft configured to reciprocate between the first and second chambers;

an arm pivotally coupled to the shaft and a pivot joint, wherein the arm extends outwardly away from the shaft in a first direction to a distal end portion, the arm has an intermediate portion between the shaft and the distal end portion, the pivot joint has a structure extending in a second direction transverse to the first direction, the intermediate portion of the arm is coupled to the structure of the pivot joint, the structure of the pivot joint is separated from the shaft by a first offset distance along the arm, and the structure of the pivot joint is separated from the distal end portion by a second offset distance along the arm.

2. The system of claim 1, wherein the arm is pivotally coupled to the valve portion via the pivot joint.

3. The system of claim 1, wherein the valve portion is fixed in position.

4. The system of claim 1, wherein the valve portion comprises a valve plate having the plurality of ports.

5. The system of claim 1, wherein the arm comprises opposite first and second arm portions disposed about opposite first and second sides of the valve portion.

6. The system of claim 5, wherein the pivot joint comprises a first pivot joint disposed between the first arm portion and the first side of the valve portion and a second pivot joint disposed between the second arm portion and the second side of the valve portion.

7. The system of claim 5, wherein the changeover assembly comprises a pusher disposed between the first and second arm portions, and at least one spring biasing the pusher against the closure portion.

8. The system of claim 7, wherein the pusher comprises a first portion disposed in a first slot along the first arm portion and a second portion disposed in a second slot along the second arm portion.

9. The system of claim 8, wherein the at least one spring comprises a first spring coupled to the first portion of the pusher and a second spring coupled to the second portion of the pusher.

10. The system of claim 7, wherein the pusher has an elongated structure that bends along its axis to define a U-shape.

11. The system of claim 1, wherein the arm comprises a U-shaped frame.

12. The system of claim 1, wherein the arm comprises opposite first and second arm portions disposed about an intermediate space, and the changeover assembly comprises at least one spring disposed outside of the intermediate space.

13. The system of claim 1, wherein the changeover assembly comprises at least one spring biasing a pusher against the closure portion.

14. The system of claim 13, wherein the pusher is configured to slide along an interior surface of at least one slot in the arm.

15. The system of claim 1, wherein the changeover assembly comprises at least one spring in tension.

16. The system of claim 1, wherein the changeover assembly comprises at least one spring disposed lengthwise along the arm.

17. The system of claim 1, wherein the changeover assembly comprises a pusher disposed against the closure portion at a position off center relative to the pivot joint.

18. The system of claim 1, wherein the first chamber comprises a first diaphragm chamber and the second chamber comprises a second diaphragm chamber.

19. The system of claim 1, wherein the pump is a gas driven pump.

20. The system of claim 1, wherein the changeover assembly comprises a pusher disposed between the distal end portion of the arm and the closure portion.

21. The system of claim 1, wherein the changeover assembly comprises at least one spring disposed between the distal end portion of the arm and the closure portion.

22. The system of claim 1, wherein the changeover assembly comprises a pusher disposed between the arm and the closure portion, wherein the pusher is a one-piece structure.

23. The system of claim 1, wherein the changeover assembly comprises a pusher disposed between the arm and the closure portion, wherein the pusher is coupled to the arm with a coupling configured to enable rotation and translational movement of the pusher relative to the arm.

24. The system of claim 1, wherein the structure of the pivot joint comprises a joint shaft disposed in a shaft opening.

25. The system of claim 24, wherein the joint shaft comprises a first pin disposed in a first opening of the shaft opening, and the joint shaft comprises a second pin disposed in a second opening of the shaft opening.

26. A system, comprising:

a changeover assembly, comprising:

a valve portion having a plurality of ports;

a closure portion configured to slide along the valve portion and selectively open and close the plurality of ports to control pressurization and exhaustion of first and second chambers of a pump;

a shaft configured to reciprocate between the first and second chambers;

an arm pivotally coupled to the shaft and a pivot joint, wherein the arm extends outwardly away from the shaft in a first direction to a distal end portion, the arm has an intermediate portion between the shaft and the distal end portion, the pivot joint has a structure extending in a second direction transverse to the first direction, the intermediate portion of the arm is coupled to the structure of the pivot joint, the structure of the pivot joint is separated from the shaft by a first offset distance along the arm, and the structure of the pivot joint is separated from the distal end portion by a second offset distance along the arm.

27. The system of claim 26, wherein the arm is pivotally coupled to the valve portion via the pivot joint.

28. The system of claim 26, wherein the changeover assembly comprises at least one spring biasing a pusher in a direction toward the shaft and against the closure portion at a position off center relative to the pivot joint, and the at least one spring is in tension.

29. The system of claim 26, wherein the structure of the pivot joint comprises a joint shaft disposed in a shaft opening.

30. A method, comprising:

reciprocating a shaft of a changeover assembly between first and second chambers of a pump;

moving, in response to reciprocating the shaft, an arm pivotally relative to the shaft and a pivot joint, wherein the arm extends outwardly away from the shaft in a first direction to a distal end portion, the arm has an intermediate portion between the shaft and the distal end portion, the pivot joint has a structure extending in a second direction transverse to the first direction, the intermediate portion of the arm is coupled to the structure of the pivot joint, the structure of the pivot joint is separated from the shaft by a first offset distance along the arm, and the structure of the pivot joint is separated from the distal end portion by a second offset distance along the arm; and sliding, in response to moving the arm, a closure portion along a valve portion to selectively open and close a plurality of ports in the valve portion to control pressurization and exhaustion of the first and second chambers of the pump.

31. The method of claim 30, comprising biasing, via at least one spring, a pusher in a direction toward the shaft and against the closure portion at a position off center relative to the pivot joint.

32. The method of claim 30, comprising moving a pusher, in response to moving the arm, between the distal end portion of the arm and the closure portion.

33. The method of claim 30, comprising spring biasing the closure portion with at least one spring disposed between the distal end portion of the arm and the closure portion.

34. The method of claim 30, wherein the structure of the pivot joint comprises a joint shaft disposed in a shaft opening.

* * * * *